US007304630B2

(12) United States Patent
Kobayashi et al.

(10) Patent No.: US 7,304,630 B2
(45) Date of Patent: Dec. 4, 2007

(54) DISPLAY DEVICE AND DRIVE METHOD THEREOF

(75) Inventors: Hiroshi Kobayashi, Kanagawa (JP); Tamaki Harano, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/565,251

(22) PCT Filed: Jul. 14, 2004

(86) PCT No.: PCT/JP2004/010377

§ 371 (c)(1),
(2), (4) Date: Jan. 19, 2006

(87) PCT Pub. No.: WO2005/013252

PCT Pub. Date: Feb. 10, 2005

(65) Prior Publication Data

US 2006/0232543 A1 Oct. 19, 2006

(30) Foreign Application Priority Data

Aug. 4, 2003 (JP) ..... 2003-285621

(51) Int. Cl.
*G09G 3/36* (2006.01)

(52) U.S. Cl. ..... 345/100; 345/98

(58) Field of Classification Search ..... 345/85–100, 345/204–215

See application file for complete search history.

(56) References Cited

U.S. PATENT DOCUMENTS 6,999,055 B2 * 2/2006 Yamashita et al. ..... 345/98
2002/0149558 A1 * 10/2002 Kashima et al. ..... 345/100
2003/0201964 A1 * 10/2003 Murade ..... 345/100
2005/0018107 A1 * 1/2005 Uamashita et al. ..... 349/98

FOREIGN PATENT DOCUMENTS

| | | |
|---|---|---|
| JP | 03-214873 | 9/1991 |
| JP | 11-65536 | 3/1999 |
| JP | 2000-267616 | 9/2000 |
| WO | WO 01/97205 | 12/2001 |
| WO | WO 03/034393 | 4/2003 |
| WO | WO 03/034395 | 4/2003 |

* cited by examiner

*Primary Examiner*—Vijay Shankar
(74) *Attorney, Agent, or Firm*—Sonnenschein Nath & Rosenthal LLP

(57) ABSTRACT

A display apparatus and a method for driving the display apparatus that are capable of suppressing image quality degradation resulting from delay in sampling pulses or from waveform rounding thereof and image quality degradation caused by coupling between the signal line and the common line and that between the signal line and the scan line even when the simultaneous sampling number is increased. The start pulse HST has a pulse width that includes a plurality of pulse widths of the clock pulses HCK and HCKX, for example, two pulse widths. The clock pulses DCK have four phases. Large margins $\alpha 1$ and $\alpha 2$ in the phase relationship between each of the clock pulses DCK1 to DCK4 and each of transfer pulses used for extracting the clock pulses DCK1 to DCK4 are assured. As a result, even if delay or waveform rounding occurs in the clock pulses DCK1 to DCK4, sampling pulses SP1 to SP6 with a constant pulse width equal to that of each of the clock pulses DCK1 to DCK4 can be generated without being affected by the delay or waveform rounding.

10 Claims, 11 Drawing Sheets

DISPLAY DEVICE AND DRIVE METHOD THEREOF

TECHNICAL FIELD

The present invention relates to a display apparatus and a method for driving the display apparatus. In particular, the present invention relates to an active matrix display apparatus that uses a dot sequential driving mode and a method for driving the active matrix display apparatus.

BACKGROUND ART

In an active matrix apparatus that includes a pixel array unit in which pixels including electrooptic elements are arranged in a matrix with a large number of rows and columns and a scan line is wired for each row and a signal line is wired for each column with respect to the pixel arrangement, a vertical driving circuit configured to select each pixel in the pixel array unit on a row-by-row basis, and a horizontal driving circuit configured to write a video signal into each pixel in a row selected by the vertical driving circuit, a dot sequential driving mode is a method that sequentially samples, e.g., analog video signals that are serially input over one horizontal scanning period and writes the sampled video signals into a corresponding signal line in the pixel array unit.

For an active matrix display apparatus that uses the dot sequential driving mode, when the number of pixels in a horizontal direction, in particular, is increased as the display apparatus realize a higher resolution, it becomes difficult to maintain a sufficient sampling period of time for sequentially sampling video signals input by one system with respect to all pixels within a limited horizontal effective period. Therefore, in order to maintain a sufficient sampling period of time, an m-dot simultaneous sampling driving mode, in which video signals are input in parallel in m systems (where m is an integer equal to or greater than two) and, with m pixels (dots) in the horizontal direction used as a unit, m sampling switches are provided and simultaneously driven by one sampling pulse to sequentially perform writing in units of m pixels, has been used (see, for example, Japanese Unexamined Patent Application Publication No. 2003-066914, in particular, paragraph 11 and FIG. 16).

As image quality and resolution in image display apparatuses increase, in projection liquid crystal display apparatuses (LCD projection apparatuses), for example, there is increasingly a demand for quantum extended graphics array (QXGA), which is a graphics display standard that supports approximately 3 million pixels (2048(H) by 1536(V) pixels).

A projection LCD apparatus is a display that uses a liquid crystal panel (liquid-crystal light valve) as an optical switching element and projects on a screen an enlarged image of an image on the liquid-crystal light valve by using a projection optical system.

In such a projection LCD apparatus, an active matrix LCD apparatus used as a liquid-crystal light valve uses a 12-dot simultaneous sampling driving mode (m=12) in a case where extended graphics array (XGA), which is a currently used graphics display standard that supports 1024(H) by 768(V), is used. In a case where the QXGA display standard is used, since the number of pixels in QXGA is four times larger than that in XGA, the simultaneous sampling number, m, is inevitably increased. Typically, the number of simultaneous sampling dots in QXGA is set to be four times larger than that in XGA, as is the case with the number of pixels, and therefore, a 48-dot simultaneous sampling driving mode is used.

However, if the simultaneous sampling number, m, is increased, a problem to be solved arises in which the waveform of a sampling pulse for driving a horizontal switch for sampling a video signal and writing it into a signal line is more rounded, which is caused by resistance and capacitive load in transients. Such delay in sampling pulses and waveform rounding thereof is a factor that causes ghosts. A cause of ghosts is now described below. The cause of ghosts occurring when the peak of black level contained in a video signal is written into a pixel column in an Nth stage (Nth column) is schematically illustrated in FIG. 10.

At an early point, i.e., before aging, which is performed to stabilize operation by the passage of electric current through the apparatus, no delay in the sampling pulses occurs, so that the black level of a video signal can be accurately sampled with the sampling pulse in the Nth stage. Therefore, no front ghost is present. In contrast to this, after aging, delay in the sampling pulses occurs, so that the peak of black level may be sampled in part with a drive pulse of the preceding stage ((N−1)th stage) in some cases. If so, front ghosts are present.

Specifically, if a liquid crystal panel is used for a long time, a threshold voltage Vth is increased because of the presence of hot carrier stress of transistors disposed in a circuit system through which sampling pulses pass. As a result, the sampling pulses are displaced in a rear direction in time and front ghosts are thus present. In particular, when thin film transistors (TFTs) are used as the transistors, the width of delay in the sampling pulses caused by hot carrier stress is on the order of 30 nanoseconds.

For an active matrix LCD apparatus, in a case where 1H inversion driving method, which inverts the polarity of a video signal to be written into each pixel for every 1H (H is a horizontal scanning period), is used, a video signal on a signal line jumps into a common line or scan line because of coupling of parasitic capacitance between the signal line and the common line or that between the signal line and the scan line. This increases the amount of variation in the potential of the common line and the scan line. Therefore, as shown in FIG. 11, horizontal crosstalk (A) and a window band (B) are clearly present, and as a result, image quality is severely degraded. FIG. 11 illustrates phenomena caused by an event in which variation in the potential of the signal line jumps into the common line or the scan line through coupling when the black level is written into the signal line.

The present invention aims to solve the problems described above. An object of the present invention is to provide a display apparatus and method for driving the display apparatus that are capable of suppressing image quality degradation resulting from delay in transmission of sampling pulses or from waveform rounding thereof and image quality degradation caused by coupling between the signal line and the common line and that between the signal line and the scan line even when the simultaneous sampling number m is increased.

DISCLOSURE OF INVENTION

To attain the object above, according to the present invention, a display apparatus includes a pixel array unit including pixels arranged in a matrix and signal lines arranged so that one corresponds to each vertical column of pixels in the matrix of pixels, clock generating means for generating a horizontal start pulse for indicating a start of horizontal scanning, first clock pulses being used as a basis for the horizontal scanning, and second clock pulses having n phases and being synchronized with the first clock pulses, where n is an integer equal to or greater than three, a shift register including cascaded shift register stages for sequentially transferring the horizontal start pulse in synchronism with the first clock pulses, the shift register being configured to successively output transfer pulses from the shift register stages, a group of first switches configured to successively generate sampling pulses by extracting the second clock pulses in response to the transfer pulses successively output from the shift register, and a group of second switches configured to successively sample input video signals in response to the sampling pulses generated by the group of first switches and to provide the video signals to the signal lines in the pixel array unit. In this display apparatus, the start pulse has a pulse width that includes a plurality of pulse widths of the first clock pulses.

In the structure described above, when the horizontal start pulse is provided to the shift register, the shift register then sequentially transfers horizontal start pulse in synchronism with the first clock pulses, successively outputs the transfer pulses from the transfer stages, and provides them to the switches in the group of first switches. The switches in the group of first switches extract the second clock pulses in response to the transfer pulses from the shift register. Since the horizontal start pulse has a pulse width that includes a plurality of pulse widths of the first clock pulses, the pulse width of each of the transfer pulses for extracting each the second clock pulses is increased in accordance with the pulse width of the horizontal start pulse. Therefore, a large margin can be obtained in the phase relationship between the second clock pulse and the transfer pulse. As a result, even if delay or waveform rounding occurs in the second clock pulse, a decrease and a variation in the pulse width of the extracted second clock pulse resulting from the delay or the waveform rounding are not present, and the second clock pulse is extracted while the pulse width thereof is constant. The extracted clock pulse is provided to each of the switches in the group of second switches as the sampling pulse.

According to the present invention, the horizontal start pulse has a pulse width that includes a plurality of pulse widths in the first clock pulses, and a margin in the phase relationship between the second clock pulse and the transfer pulse is large, so that, even if delay or waveform rounding occurs in the second clock pulse, the sampling pulse with a constant pulse width equal to that of the second clock pulse can be generated. As a result, the occurrence of vertical streaks or other image defects can be prevented reliably, thus improving image quality.

BEST MODE FOR CARRYING OUT THE INVENTION

Embodiments in the present invention are described with reference to the drawings.

Figure 1:
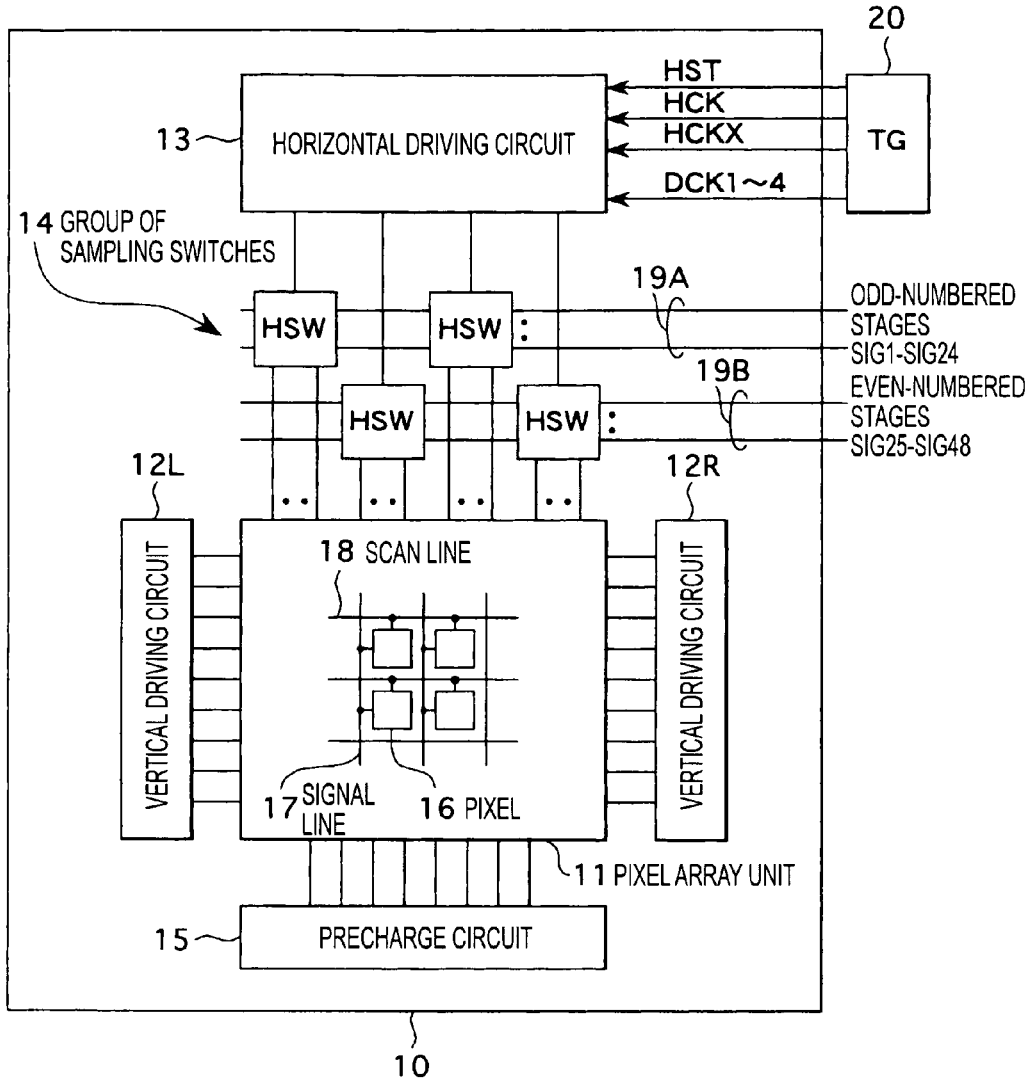
FIG. 1 is a block diagram schematically showing a fundamental structure of a display apparatus according to an embodiment of the present invention.

FIG. 1 is a block diagram schematically showing a fundamental structure of a display apparatus, and more specifically, an active matrix display apparatus that uses the dot sequential driving mode, according to an embodiment of the present invention. In FIG. 1, a pixel array unit 11, vertical driving circuits 12L and 12RB, a horizontal driving circuit 13, a group of sampling switches 14, and the like that serve as fundamental components of the display apparatus are integrated with a display panel 10. The display apparatus has a structure in which the vertical driving circuits 12L and 12R are disposed on left and right sides of the pixel array unit 11, respectively. However, the display apparatus may have a structure in which a vertical driving circuit is disposed on only one side of the pixel array unit 11. In addition to the components mentioned above, for the purpose of improving image quality, in case of necessity, a precharge circuit 15 for performing precharge before a video signal is written may be provided on a side opposite to the horizontal driving circuit 13 in such a way that that the pixel array unit 11 is disposed between the horizontal driving circuit 13 and the precharge circuit 15.

The pixel array unit 11 includes a large number of pixels 16 two-dimensionally arranged in a matrix, and with respect to the arrangement of the large number of pixels 16, signal lines 17 are wired so that one corresponds to each column along the arrangement of the pixels and scan lines (gate lines) 18 are wired so that one corresponds to each row along the arrangement of the pixels. In other words, the pixel array unit 11 has a structure in which the pixels 16 are arranged at the intersections of the signal lines 17 and the scan lines 18 arranged in a matrix. A display apparatus according to this embodiment includes the number of pixels supporting a graphics display standard of QXGA (2048(H)×1536(V)).

Each of the vertical driving circuits 12L and 12R includes, for example, a shift register in which cascaded shift register stages (transfer stages) for sequentially transferring signals are arranged and is configured to successively provide scan pulses to the scan lines 18 connected to output ends of the shift register stages and thereby sequentially select on a row-by-row basis the pixels 16 in one row connected to one of the scan lines 18 to which one of the scan pulses is provided. The horizontal driving circuit 13 operates on the basis of various timing pulses generated by a timing generator (timing generating circuit (TG)) 20 disposed outside the display panel 10, successively generates sampling pulses, and sequentially drives the switches HSW in the group of sampling switches 14. A concrete structure of the horizontal driving circuit 13 will be described later.

The switches HSW in the group of sampling switches 14 sequentially sample video signals externally input through video lines divided into at least two systems, video line sets 19A and 19B, in synchronism with the sampling pulses successively output from the horizontal driving circuit 13 and provide the video signals to the signal lines 17 in the pixel array unit 11, thereby writing the video signals into the respective pixels 16 in a row that is selected by the vertical driving circuits 12L and 12R.

Specifically, the switches HSW in the group of sampling switches 14 are divided into two subgroups including a first subgroup of nonadjacent sampling switches and a second subgroup of sampling switches arranged next to the sampling switches in the first subgroup. In this embodiment, the switches HSW are divided into two subgroups. However, the switches HSW may be divided into three or more subgroups.

In a case where the switches HSW are divided into two subgroups, like in this embodiment, in the arrangement of the switches HSW in the group of sampling switches 14, odd-numbered sampling switches belong to a first subgroup (odd-number subgroup) and even-numbered sampling switches belong to a second subgroup (even-number subgroup). The sampling switches in the odd-number subgroup are connected to the first-system video line set 19A, and the sampling switches in the even-number subgroup are connected to the second-system video line set 19B.

The display apparatus according to this embodiment includes the number of pixels supports the QXGA standard. Since the number of pixels for the QXGA standard is four times larger than that for the XGA standard, for example, the simultaneous sampling number m is set at the number four times larger than that for the XGA standard, as with the case of the number of pixels, and a 48-dot (24 dots+24 dots) simultaneous sampling driving mode is used. Specifically, each of the first-system video line set 19A and the second-system video line set 19B is composed of 24 video lines. Video signals provided through the video line sets 19A and 19B, 48 video lines in total, are simultaneously sampled after being divided into two 24-dot systems (24 dots+24 dots simultaneous sampling) and then written into the pixels 16 in the matrix.

More specifically, in the group of sampling switches 14, the odd-number subgroup has 24 sampling switches HSW which simultaneously sample 24 video signals SIG1 to SIG24 provided through the video line set 19A composed of 24 video lines and provide the video signals to the respective signal lines 17 composed of 24 lines. The even-number subgroup has 24 sampling switches HSW which simultaneously sample 24 video signals SIG25 to SIG48 provided through the video line set 19A composed of 24 video lines and provide the video signals to the respective signal lines 17 composed of 24 lines in parallel with the sampling operation in the switches HSW in the odd-number subgroup.

Figure 2:
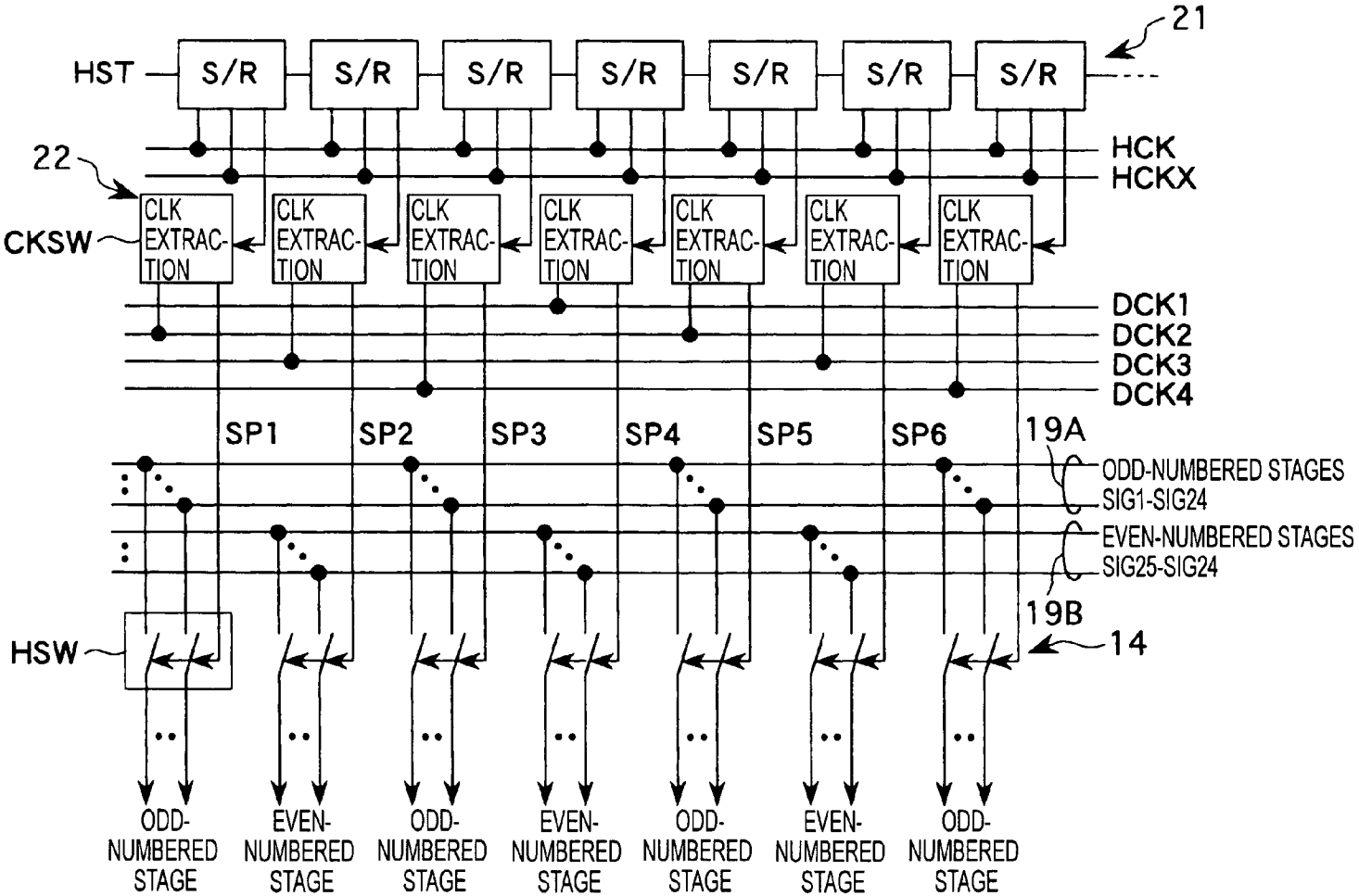
FIG. 2 is a block diagram showing a concrete structure of a horizontal driving circuit.

FIG. 2 is a block diagram showing a concrete structure of the horizontal driving circuit 13 shown in FIG. 1. Various timing pulses generated by the timing generator 20, which is disposed outside the display panel 10, are appropriately provided to the horizontal driving circuit 13. The timing generator 20 generates as the various timing pulses a horizontal start pulse HST for indicating a start of horizontal scanning, horizontal clock pulses HCK and HCKX being used as a basis for the horizontal scanning and having opposite phases, clock pulses DCK having n phases, for example, DCK1 to DCK 4 having 4 phases, and being synchronized with the horizontal clock pulses HCK and HCKX (where n is an integer equal to or greater than three), and the like. The timing relationship among the horizontal start pulse HST, horizontal clock pulses HCK and HCKX, and 4-phase clock pulses DCK1 to DCK4 is shown in FIG. 3.

Figure 3:
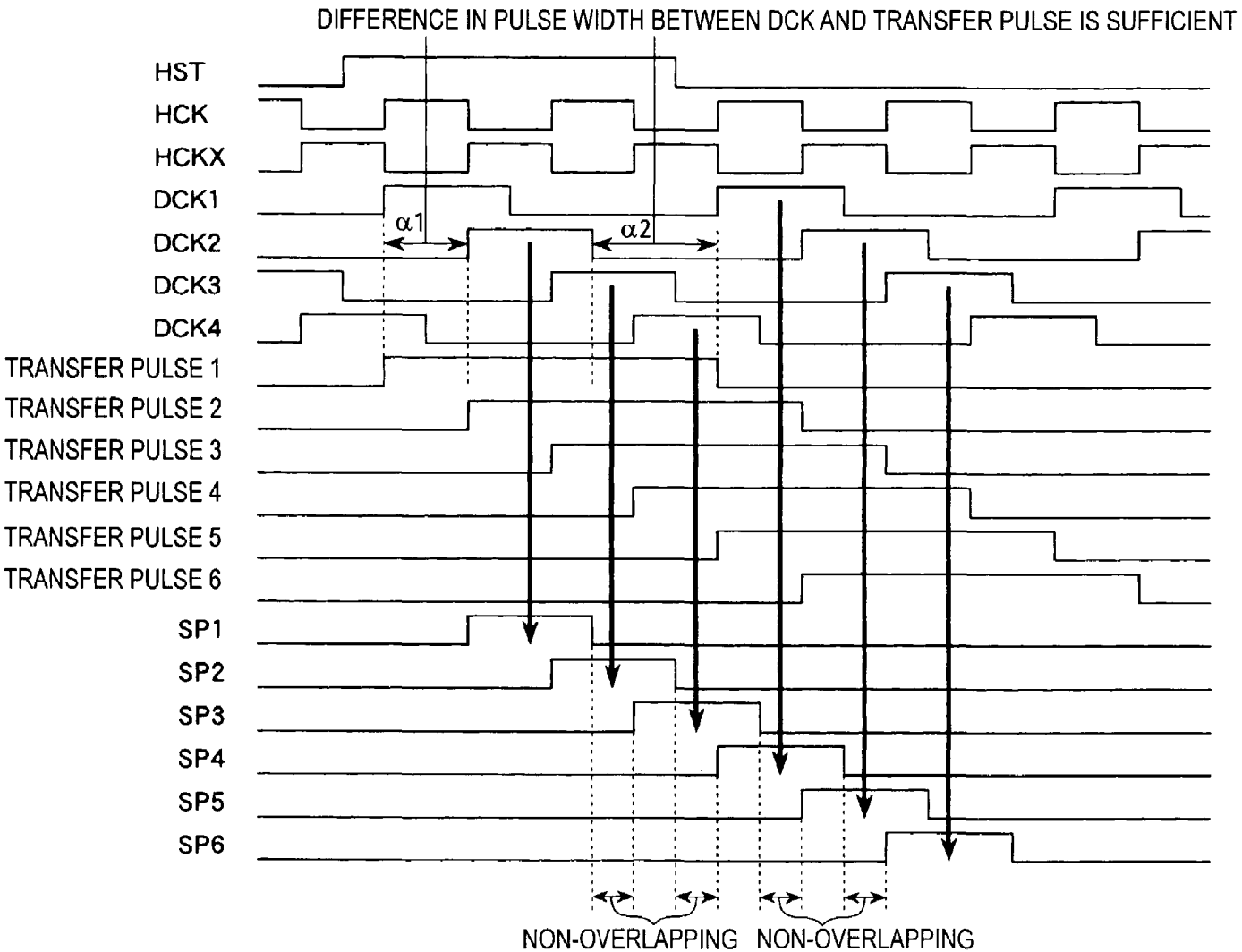
FIG. 3 is a timing chart showing the timing relationship among a horizontal start pulse HST, horizontal clock pulses HCK and HCKX, four-phase clock pulses DCK1 to DCK4, transfer pulses 1 to 6, and sampling pulses SP1 to SP6.

As is obvious from the timing chart of FIG. 3, each of the horizontal clock pulses HCK and HCKX is a pulse signal with a 50% duty ratio. With respect to the horizontal clock pulses HCK and HCKX, the horizontal start pulse HST has a pulse width that includes a plurality of pulse widths of the horizontal clock pulses HCK, in this embodiment, two pulse widths. Each of the clock pulses DCK1 to DCK4 has a pulse interval that is twice that of each of the horizontal clock pulses HCK and HCKX and has a pulse width larger than that of each of the horizontal clock pulses HCK and HCKX (e.g., 1.5 times larger than that of each of the horizontal clock pulses HCK and HCKX). The clock pulses DCK1 to DCK 4 have 90° out of phase with each other.

The horizontal driving circuit 13 includes a shift register 21 and a group of extraction switches 22. The shift register 21 shifts (transfers) the horizontal start pulse HST in synchronism with the horizontal clock pulses HCK and HCKX and successively outputs transfer pulses 1, 2, 3, 4, 5, 6, . . . from shift register stages (S/R). Since a 24 dots+24 dots simultaneous sampling driving mode is used in the display apparatus according to this embodiment, the shift register 21 is driven at double speed by setting a pulse interval of the horizontal clock pulses HCK and HCKX at half a pulse interval defined when a 48-dot simultaneous sampling driving mode is used.

The transfer pulses 1, 2, 3, 4, 5, 6, . . . successively output from the shift register 21 are provided to extraction switches CKSW in the group of extraction switches 22. Like the group of sampling switches 14, the extraction switches CKSW in the group of extraction switches 22 are divided into a first subgroup of nonadjacent extraction switches, a second subgroup of extraction switches arranged next to the extraction switches in the first subgroup, a third subgroup of extraction switches arranged next to the extraction switches in the second subgroup, and a four subgroup of extraction switches arranged next to the extraction switches in the third subgroup.

The extraction switches in the first subgroup input the clock pulses DCK2, those in the second subgroup input the clock pulses DCK3, those in the third subgroup input the clock pulses DCK4, and those in the four subgroup input the clock pulses DCK1. Therefore, when the transfer pulses 1, 2, 3, 4, 5, 6, . . . successively output from the shift register 21 are provided, the extraction switches CKSW in the group of extraction switches 22 then extract the clock pulses DCK2, DCK3, DCK 4, and DCK1 one after another in response to the transfer pulses 1, 2, 3, 4, 5, 6, . . . . This extraction operation allows the extracted pulses to have a pulse width larger than that of each of the horizontal clock pulses HCK and HCKX.

The extracted pulses are provided as sampling pulses SP1, SP2, SP3, SP4, SP5, SP6, . . . to the sampling switches HSW in the group of sampling switches 14. Specifically, the odd-numbered sampling pulses SP1, SP3, SP5, . . . are provided to the sampling switches HSW belonging to the odd-number subgroup (odd-numbered stages), and the even-numbered sampling pulses SP2, SP4, SP6, . . . are provided to the sampling switches HSW belonging to the even-number subgroup (even-numbered stages).

In other words, the sampling pulses SP1, SP2, SP3, SP4, SP5, SP6, . . . successively output from the horizontal driving circuit 13 are distributed into the sampling switches HSW in the odd-number subgroup and those in the even-number subgroup one after another. The timing relationship among the 4-phase clock pulses DCK1, DCK2, DCK3, and DCK4, the transfer pulses 1, 2, 3, 4, 5, and 6, and the sampling pulses SP1, SP2, SP3, SP4, SP5, and SP6 is shown in FIG. 3.

Therefore, the sampling pulses SP1, SP2, SP3, SP4, SP5, SP6, . . . are distributed into the odd-number subgroup and the even-number subgroup one after another, and each of the sampling pulses has a pulse width larger than that of each of the horizontal clock pulses HCK and HCKX, so that the waveforms of adjacent sampling pulses in a train of odd-numbered pulses do not overlap with each other (non-overlap), and the waveforms of adjacent sampling pulses in a train of even-numbered pulses do not overlap with each other (non-overlap), as is obvious from the timing chart of FIG. 3.

For active matrix display apparatuses that use the dot sequential driving mode, the presence of ghosts or vertical streaks is considered as one factor to degrade image quality. Ghosts are an image defect caused by incorrectly sampling a video signal to be sampled in an adjacent stage because of variations or delays in output timing of sampling pulses. In order to suppress the occurrence of ghosts, it is effective to increase the distance between adjacent sampling pulses (non-overlapping period of time) as much as possible. However, as the non-overlapping period of time is increased, the pulse width of each of the sampling pulses is decreased accordingly.

On the other hand, vertical streaks are an image defect caused by errors in display density occurring between pixels in adjacent columns resulting from insufficient or incomplete sampling of a video signal to a signal line because of variations in width of each of the sampling pulses. In order to suppress the occurrence of vertical streaks, it is preferable that the pulse width of the sampling pulse be increased as much as possible. However, since a sampling period for each row is limited to within one horizontal effective period, if the pulse width of the sampling pulse is increased, the non-overlapping period of time is reduced accordingly.

In other words, a larger overlapping period of time between sampling pulses for adjacent stages is effective in suppressing the occurrence of ghosts, whereas a larger pulse width of the sampling pulse is effective in suppressing the occurrence of vertical streaks. As is apparent from the above description, however, effective measures against ghosts and those against vertical streaks are opposed to each other, and therefore, one is traded off for the other.

In contrast to this, for the display apparatus according to this embodiment, video signals are divided into two systems, and, in accordance with this division, sampling pulses are distributed into odd-number subgroup and even-number subgroup one after another and extracted as a pulse having the pulse width larger than that of each of the horizontal clock pulses HCK and HCKX. Therefore, adjacent sampling pulses overlap with each other, sampling pulses in the odd-numbered stages do not overlap, sampling pulses in the even-numbered stages do not overlap, and the sampling switches HSW in the group of sampling switches 14 can be driven by using these sampling pulses. As a result, ghosts can be prevented from appearing.

Figure 4:
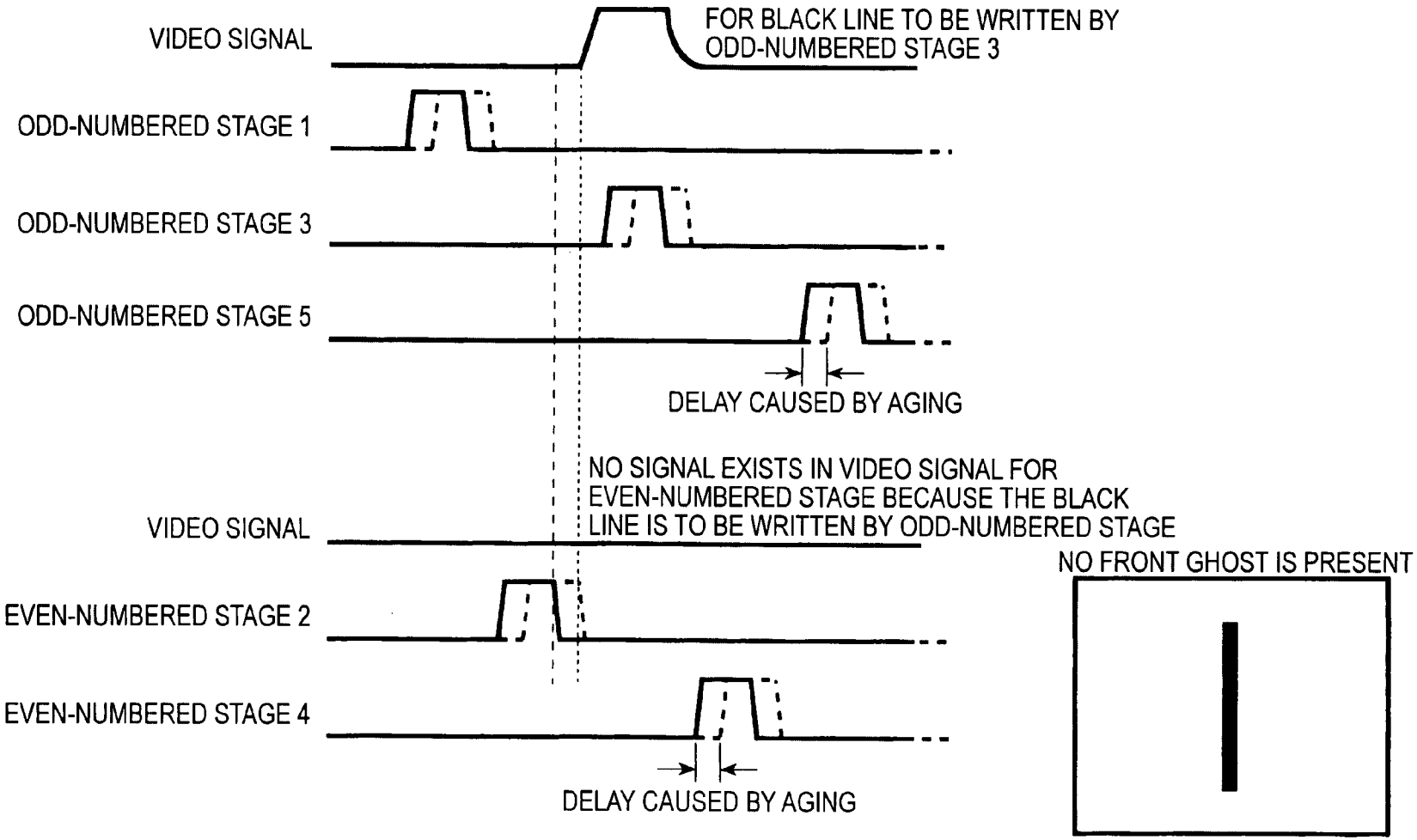
FIG. 4 is a timing chart for explaining operation occurring when no ghost is present.

The operation to prevent the occurrence of ghosts according to the present invention is further described with reference to FIG. 4. Here, a case where a black line is to be written into pixels in an odd-numbered stage (odd-numbered pixel column) 3 is described as one instance. In this case, a video signal exhibits the waveform shown in FIG. 4. A sampling pulse in the odd-numbered stage 3 is generated so as to correspond to the peak portion of the video signal. The phases of sampling pulses vary with time, and the sampling pulses are delayed by aging, which is operation to stabilize operation by the passage of electric current through a product, as shown in FIG. 4. As a result, the time at which the video signal is sampled is shifted. However, the sampling pulse in the odd-numbered stage 3 can sample the peak of the video signal unless the delay is significantly large. Therefore, a single black line is displayed in the pixel column corresponding to the odd-numbered stage 3 in the pixel array unit 11.

Figure 5:
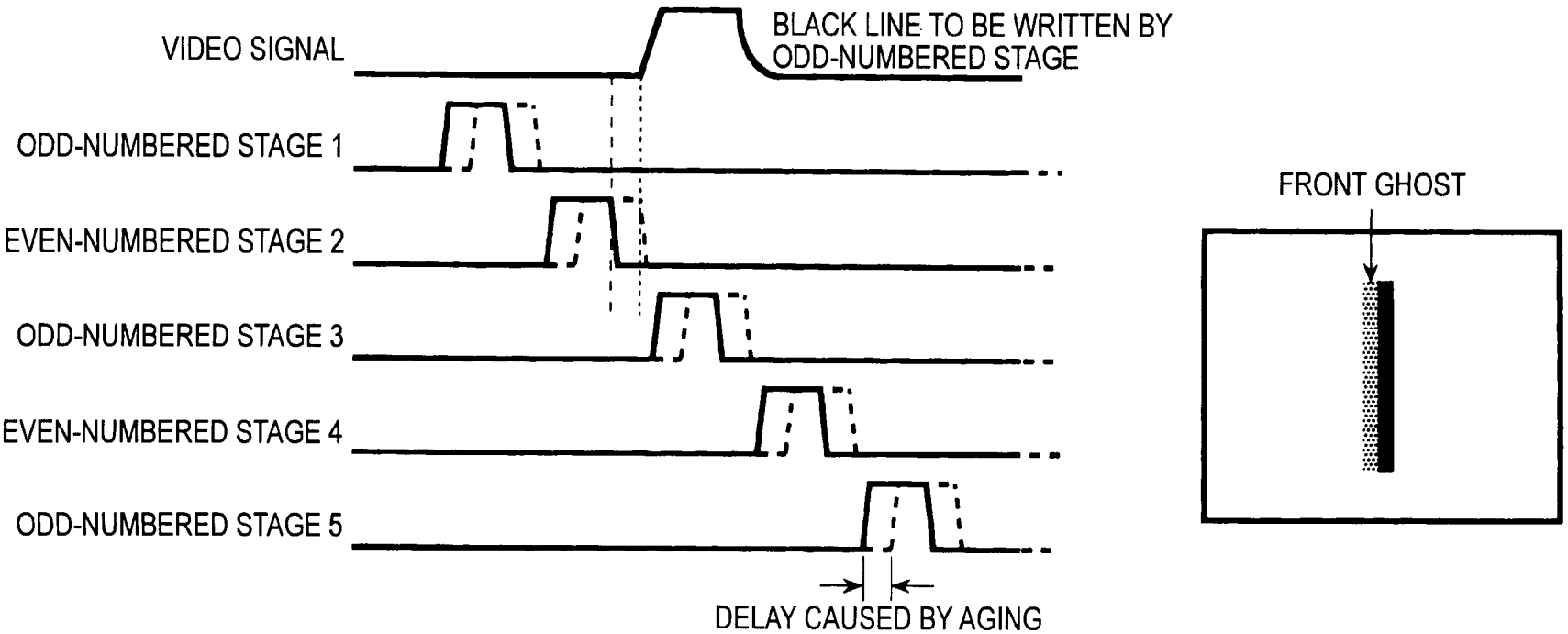
FIG. 5 is a timing chart for explaining operation occurring when ghosts are present.

On the other hand, since the black line is not to be written into the pixels in even-numbered stages, a video signal provided to the even-numbered stages (even-numbered pixel column) includes no peak portion. Therefore, the waveform of the video signal is flat so as to correspond to a background color (in this embodiment, white). This flat video signal is successively sampled with sampling pulses in the even-numbered stages 2 and 4. Although the sampling pulse in the even-numbered stage 2 is changed by delay caused by aging, since the video signal includes no peak corresponding to the black line, no ghost is present. If the video lines in the even-numbered stages and those in the odd-numbered stages are not independent of each other, as a result of delay of the sampling pulse in the even-numbered stage 2 caused by aging, the peak of the video signal to be written into the odd-numbered stage 3 is incorrectly sampled, as shown in FIG. 5, and therefore, a front ghost is present.

Figure 6:
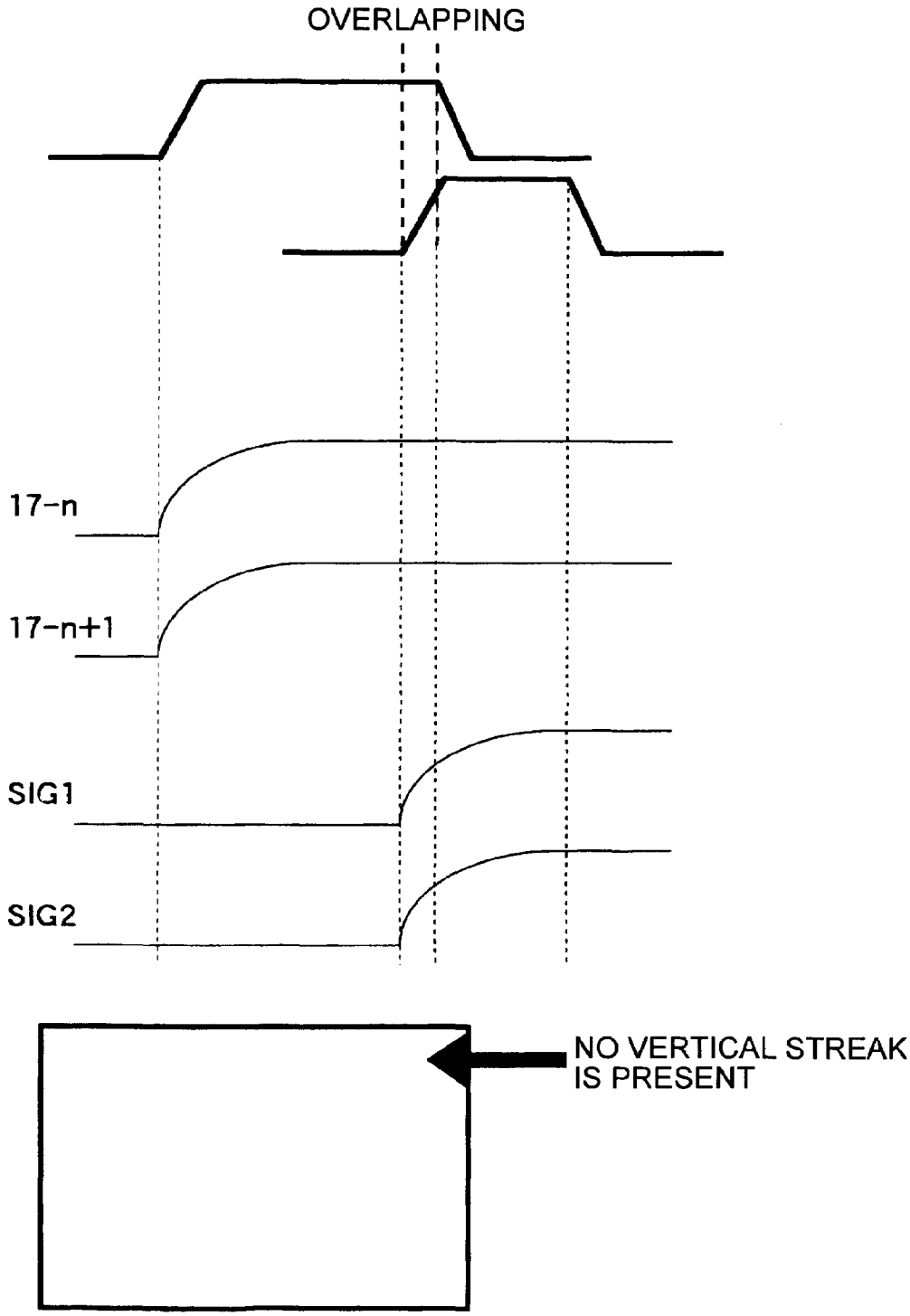
FIG. 6 is a timing chart for explaining operation occurring when no vertical streak is present.
Figure 7:
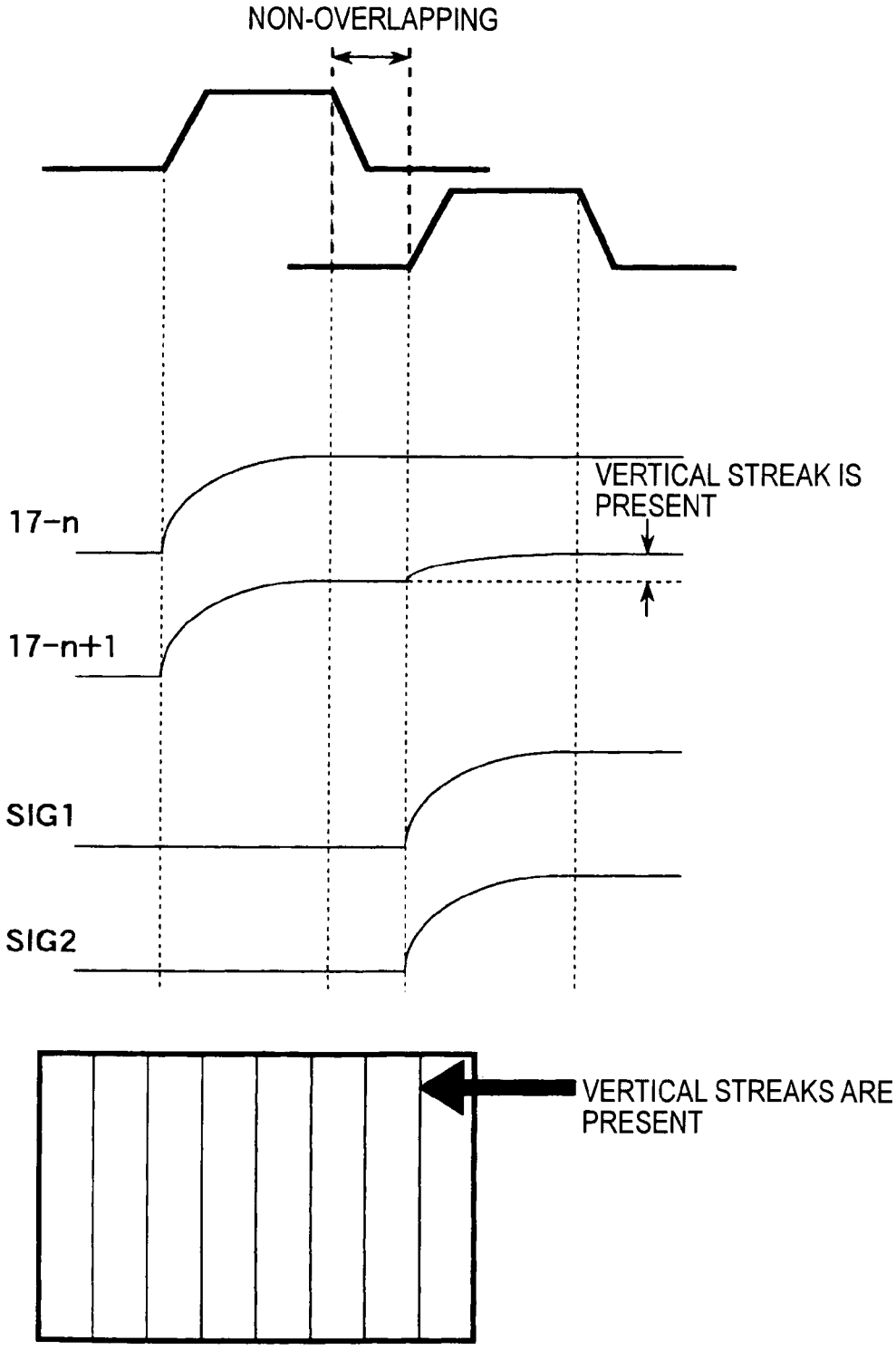
FIG. 7 is a timing chart for explaining operation occurring when vertical streaks are present.

As for vertical streaks, since a driving mode in which sampling pulses in adjacent stages overlap with each other is used in the display apparatus according to this embodiment, as shown in FIG. 6, writing the potential of a signal line in the current stage begins before holding operation in the previous stage. Therefore, vertical streaks are avoided. If a driving mode in which sampling pulses in adjacent stages do not overlap with each other is used, as shown in FIG. 7, the potential hold in the previous stage is raised by the current stage due to the amount of coupling present between adjacent signal lines 17-$n$ and 17-$n$+1, thus causing vertical streaks.

In particular, in the display apparatus according to this embodiment, the horizontal start pulse HST has a pulse width that includes a plurality of pulse widths of the horizontal clock pulses HCK (in this embodiment, two pulse widths), and the clock pulses DCK extracted by the group of extraction switches 22 have three or more phases (in this embodiment, four phases). Therefore, the pulse width of a transfer pulse for extracting each of the clock pulses DCK is increased in accordance with the pulse width of the horizontal start pulse HST. As a result, even when the pulse width of the extracted clock pulse DCK is larger than that of each of the horizontal clock pulses HCK and HCKX, large margins $\alpha$1 and $\alpha$2 can be obtained in the phase relationship between the clock pulse DCK and the transfer pulse used for extracting the clock pulse DCK. As a result, a video signal can be sampled reliably without being affected by a phase shift of the clock pulse DCK.

In other words, in a case where TFTs are used as the transistors in a circuit system through which the clock pulse DCK pass, even if a somewhat large phase shift, including delay and waveform rounding, occurs in the clock pulse DCK, since large margins $\alpha$1 and $\alpha$2 exist before and after the clock pulse DCK, the clock pulse DCK always lies within the pulse width of the transfer pulse. As a result, the clock pulse DCK can be used as the sampling pulse after being extracted without being processed. Therefore, the sampling pulse with a pulse width equal to that of the clock pulse DCK, i.e., larger than that of each of the horizontal clock pulses HCK and HCKX can be generated.

In terms of suppressing the occurrence of vertical streaks, as previously described, setting the pulse width of the sampling pulse so as to be larger as much as possible can reliably prevent vertical streaks from appearing. As a result, even if a phase shift occur in the clock pulse DCK, the sampling pulses with a constant pulse width equal to that of the clock pulse DCK can be generated without being affected by the phase shifts. Therefore, the largeness of the pulse width of each of the sampling pulses allows a desired potential to be reliably written into the signal lines 17, and the constancy of the pulse width reliably prevents vertical streaks from appearing.

REFERENCE EXAMPLE

Figure 8:
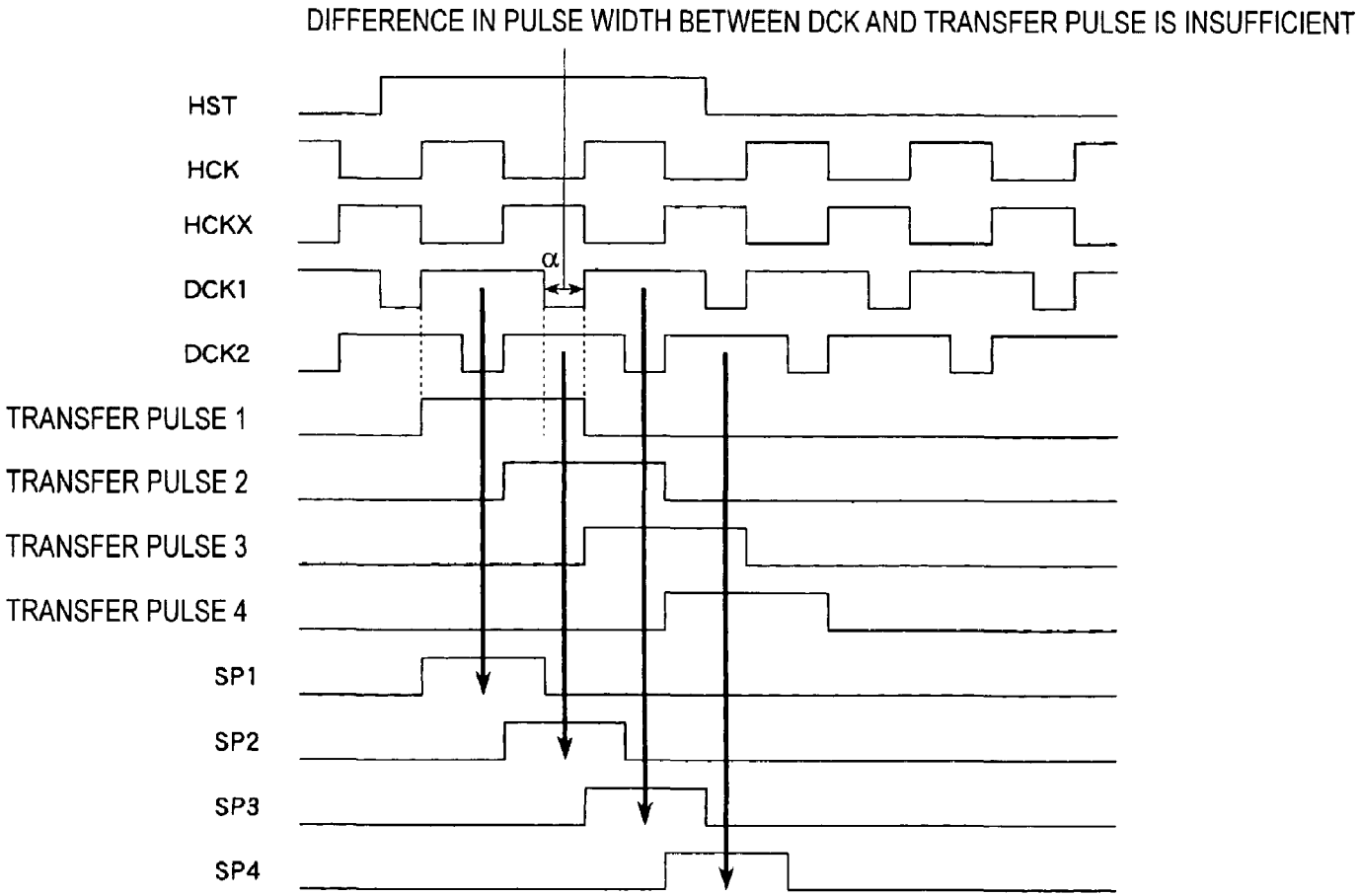
FIG. 8 is a timing chart for explaining operation in a reference example.

The timing relationship in a case where the horizontal start pulse HST has a pulse width that includes a pulse width of the horizontal clock pulse HCK and where the clock pulses DCK have two phases is shown as a reference example in FIG. 8. In this case, the pulse width of each of the transfer pulses used for extracting each of the clock pulses DCK is small in accordance with the pulse width of the horizontal start pulse HST, and therefore, a margin $\alpha$ in the phase relationship between the extracted clock pulse DCK and the transfer pulse extracting it is inevitably very small.

In a case where the difference in pulse width between the clock pulse DCK and the transfer pulse is insufficient, if a phase shift larger than the margin $\alpha$ occurs in the clock pulse DCK, the clock pulse DCK deviates from the pulse width of the transfer pulse. As a result, the pulse width of each of the sampling pulses is smaller than that of the clock pulse DCK, and the pulse width varies with the amount of the phase shift. In extreme cases, adjacent sampling pulses are combined into a two-peak pulse. As a result, the smallness of the pulse width of the sampling pulse prohibits a desired potential from being written in the signal lines 17, and the variations in the pulse width cause vertical streaks. In addition, the two-peak pulse prohibits an image from being displayed normally.

This embodiment is predicated on a case where the apparatus supports the QXGA display standard and is described using as an instance a case where 24 dots+24 dots simultaneous sampling, in which the video signals are simultaneously sampled after being divided into two 24-dot systems, is performed. However, the present invention is not limited to the apparatus supporting the QXGA display standard. Furthermore, a simultaneous sampling that uses one system, instead of two systems, (for the QXGA display standard, 48-dot simultaneous sampling) may be used. In a case where such a simultaneous sampling with one system is used, it is necessary to set the pulse width of the clock pulse DCK so as to be smaller than that of each of the horizontal clock pulses HCK and HCKX.

EXAMPLE

Figure 9:
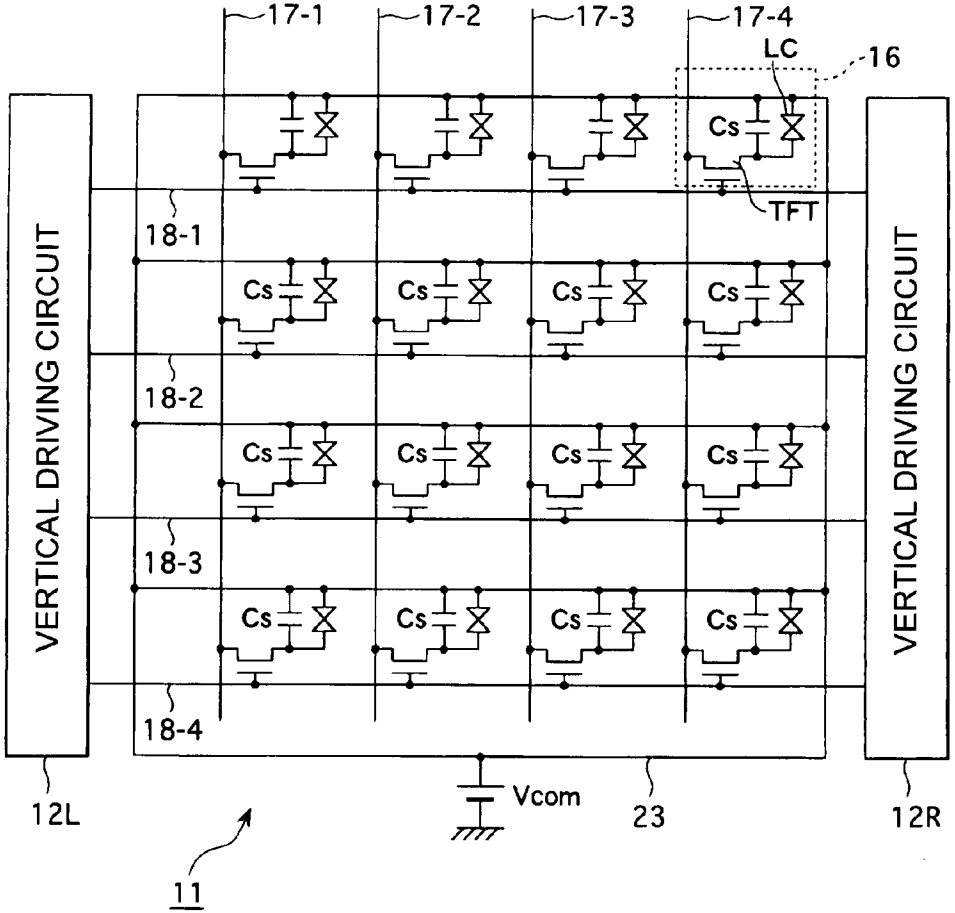
FIG. 9 is a circuit diagram showing an example of a display apparatus according to the embodiment of the present invention.
Figure 10:
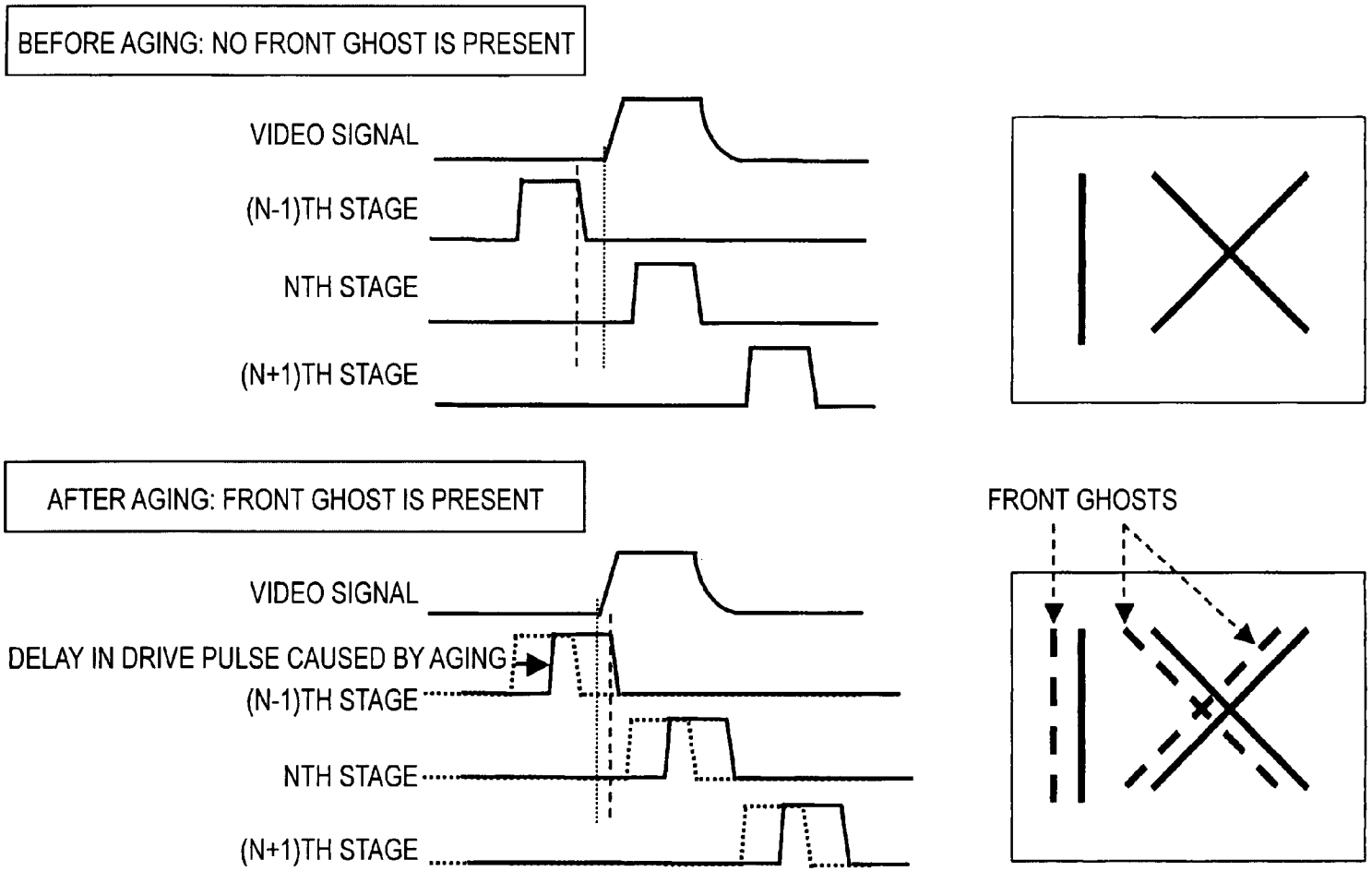
FIG. 10 is a first illustration for explaining problems to be solved in conventional techniques.
Figure 11:
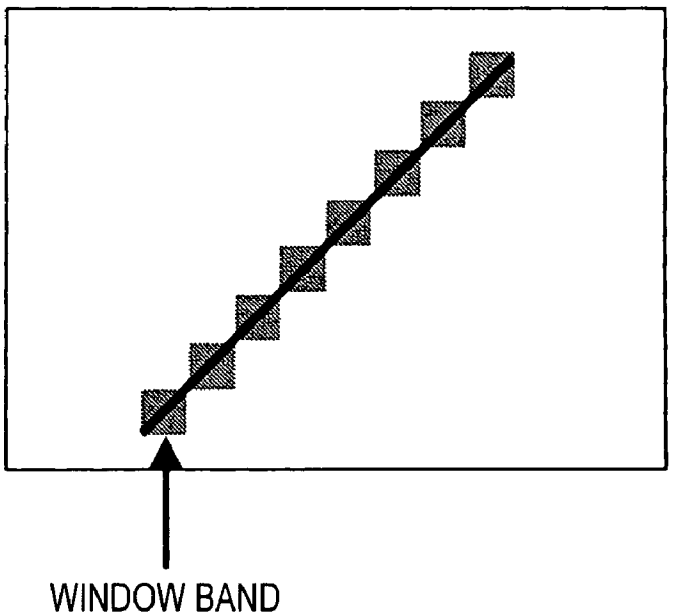
FIG. 11 is a second illustration for explaining problems to be solved in conventional techniques.
Figure 11:
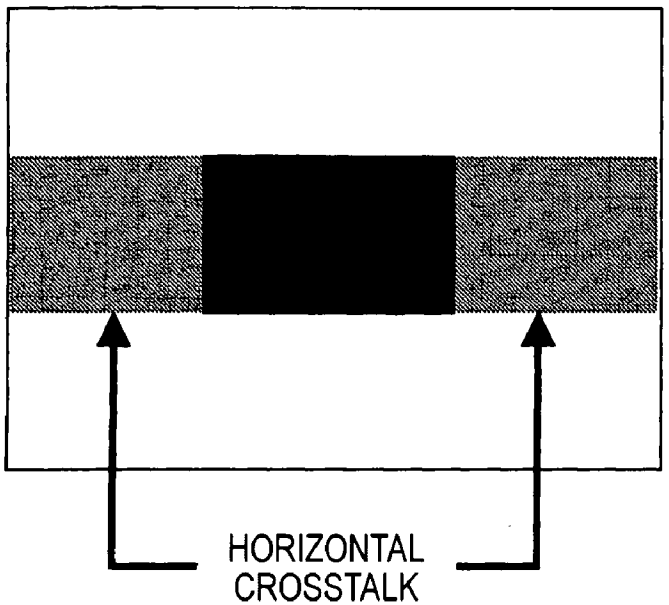

FIG. 9 is a circuit diagram showing a concrete example of the display apparatus according to the embodiment. In FIG. 9, components similar to those in FIG. 1 have the same reference numerals.

The display apparatus according to this example is an active matrix LCD apparatus that uses the dot sequential driving mode and that uses LCD cells as display elements (electrooptic elements) in the pixels 16. Here, for the sake of simplification of the figure, a 4 by 4 matrix of pixels is shown as an instance. For an LCD apparatus, the display panel 10 shown in FIG. 1 is a LCD panel in which two transparent substrates that face each other with a predetermined gap therebetween filled with a liquid crystal substance are integrally formed. The two transparent substrates are composed of, for example, a first glass substrate that is a TFT substrate in which TFTs serving as pixel transistors are arranged and a second glass substrate that is an opposing substrate arranged so as to face the TFT substrate.

In FIG. 9, the pixels 16 in a 4 by 4 matrix include respective thin film transistors TFT serving as pixel transistors, respective liquid crystal cells LC whose pixel electrodes are individually connected to drain electrodes of the thin film transistors TFT, and storage capacitors Cs whose first electrodes are connected to the drain electrodes of the thin film transistors TFT. Here, the liquid crystal cells LC mean liquid crystal capacitance existing between the pixel electrodes and opposing electrodes facing the pixel electrodes.

With the pixels 16, signal lines 17-1 to 17-4 are wired so that one corresponds to each column along the arrangement of pixels, and scan lines 18-1 to 13-8 are wired so that one corresponds to each row along the arrangement of pixels. Source electrodes (or the drain electrodes) in the thin film transistors TFT are individually connected to the corresponding signal lines 17-1 to 17-4. Gate electrodes of the thin film transistors TFT are individually connected to the scan lines 18-1 to 18-4. The opposing electrodes of the liquid crystal cells LC and second electrodes of the storage capacitors Cs are connected to a common line 23, which is common among the pixels. A predetermined direct-current voltage is applied to the common line 23 as common voltage Vcom.

As described above, the pixel array unit 11 includes the pixels 16 arranged in a matrix, the signal lines 17-1 to 17-4 arranged so that one corresponds to each column, and the scan lines 18-1 to 18-4 arranged so that one corresponds to each row. In this pixel array unit 11, both ends of the scan lines 18-1 to 18-4 are connected to output ends of the shift register stages in, for example, the vertical driving circuits 12L and 12R arranged at left and right sides of the pixel array unit 11.

In the active matrix LCD apparatus that uses the dot sequential driving mode according to the example described above, peripheral driving circuit in the pixel array unit 11, i.e., the vertical driving circuits 12L and 12R, the horizontal driving circuit 13, the group of sampling switches 14, and other circuits are basically the same as those in the display apparatus according to the embodiment shown in FIGS. 1 and 2. As a result, the LCD apparatus according to this example can obtain operation effect, as in the case of the display apparatus according to the embodiment.

Additionally, according to the LCD apparatus according to the example, in a case where the apparatus supports the QXGA display standard, 24 dots+24 dots simultaneous sampling, in which video signals are simultaneously sampled after being divided into two 24-dot systems, is used, instead of 48-dot simultaneous sampling with one system, the amount of video signals that jump into the common line 23 or the scan lines 18 because of coupling between the signal lines 17 and the common line 23 and that between the signal lines 17 and the scan lines 18 can be reduced to about half, and the amount of variations in the potential of the common line 23 or the scan lines 18 resulting from this jump phenomenon can be reduced to about half. As a result, operation effect of suppression of the occurrence of horizontal crosstalk and a window band can also be obtained.

INDUSTRIAL APPLICABILITY

An active matrix LCD apparatus that uses the dot sequential driving mode according to this example in the present invention is suitably used as a LCD light valve in, for example, a projection LCD apparatus (LCD projector apparatus).

The invention claimed is:

1. A display apparatus comprising:

a pixel array unit including pixels arranged in a matrix and signal lines arranged so that one corresponds to each vertical column of pixels in the matrix of pixels;

a clock generating unit for generating a horizontal start pulse for indicating a start of horizontal scanning, first clock pulses being used as a basis for the horizontal scanning, and second clock pulses having n phases and being synchronized with the first clock pulses, where n is an integer equal to or greater than three;

a shift register including cascaded shift register stages for sequentially transferring the horizontal start pulse in synchronism with the first clock pulses, the shift register being configured to successively output transfer pulses from the shift register stages;

a group of first switches configured to successively generate sampling pulses by extracting the second clock pulses in response to the transfer pulses successively output from the shift register; and a group of second switches configured to successively sample input video signals in response to the sampling pulses generated by the group of first switches and to provide the video signals to the signal lines in the pixel array unit, wherein, the start pulse has a pulse width that includes a plurality of pulse widths of the first clock pulses, and the group of second switches are divided into at least two subgroups including a first subgroup of nonadjacent second switches and a second subgroup of second switches arranged next to the second switches in the first subgroup, the video signals are divided into at least two signal groups and then provided to the at least two subgroups of second switches, respectively, and the sampling pulses generated by the group of first switches are divided and provided to the at least two subgroups of switches in the group of second switches.

2. The display apparatus according to claim 1, wherein a pulse interval of the second clock pulses is n times a pulse interval of the first clock pulses, where n is an integer equal to or larger than three.

3. The display apparatus according to claim 2, wherein a pulse width of each of the second clock pulses is larger than a pulse width of each of the first clock pulses.

4. The display apparatus according to claim 1, wherein a pulse interval of the second clock pulses is n times a pulse interval of the first clock pulses, where n is an integer equal to or larger than three.

5. The display apparatus according to claim 4, wherein a pulse width of each of the second clock pulses is larger than a pulse width of each of the first clock pulses.

6. The display apparatus according to claim 1, wherein electrooptic elements in the pixels are liquid crystal cells.

7. The display apparatus according to claim 5, wherein the group of second switches are divided into at least two subgroups including a first subgroup of nonadjacent second switches and a second subgroup of second switches arranged next to the second switches in the first subgroup, the video signals are divided into at least two signal groups and then provided to the at least two subgroups of second switches, and the sampling pulses generated by the group of first switches are divided and provided to the at least two subgroups of switches in the group of second switches.

8. A method for driving a display apparatus, the display apparatus comprising:

a pixel array unit including pixels arranged in a matrix and signal lines arranged so that one corresponds to each vertical column of pixels in the matrix of pixels;

a clock generating unit for generating a horizontal start pulse for indicating a start of horizontal scanning, first clock pulses being used as a basis for the horizontal scanning, and second clock pulses having n phases and being synchronized with the first clock pulses, where n is an integer equal to or greater than three;

a shift register including cascaded shift register stages for sequentially transferring the horizontal start pulse in synchronism with the first clock pulses, the shift register being configured to successively output transfer pulses from the shift register stages;

a group of first switches configured to successively generate sampling pulses by extracting the second clock pulses in response to the transfer pulses successively output from the shift register; and a group of second switches configured to successively sample input video signals in response to the sampling pulses generated by the group of first switches and to provide the video signals to the signal lines in the pixel array unit, wherein, the start pulse has a pulse width that includes a plurality of pulse widths of the first clock pulses, and the group of second switches are divided into at least two subgroups including a first subgroup of nonadjacent second switches and a second subgroup of second switches arranged next to the second switches in the first subgroup, the video signals are divided into at least two signal groups and then provided to the at least two subgroups of second switches, respectively, and the sampling pulses generated by the group of first switches are divided and provided to the at least two subgroups of switches in the group of second switches.

9. The method of driving the display apparatus according to claim 8, wherein a pulse interval of the second clock pulses is n times a pulse interval of the first clock pulses, where n is an integer equal to or larger than three.

10. The method of driving the display apparatus according to claim 8, wherein a pulse width of each of the second clock pulses is larger than a pulse width of each of the first clock pulses.

* * * * *